US006715960B2

(12) United States Patent
Metz

(10) Patent No.: US 6,715,960 B2
(45) Date of Patent: Apr. 6, 2004

(54) COLLAPSIBLE AND RE-USABLE FLOOD BARRIER

(76) Inventor: Donald H. Metz, 6287 Summit Ct., Traverse City, MI (US) 49686

( * ) Notice: Subject to any disclaimer, the term of this patent is extended or adjusted under 35 U.S.C. 154(b) by 0 days.

(21) Appl. No.: 10/175,687

(22) Filed: Jun. 20, 2002

(65) Prior Publication Data

US 2003/0035689 A1 Feb. 20, 2003

Related U.S. Application Data

(63) Continuation of application No. 09/929,467, filed on Aug. 14, 2001, now abandoned.

(51) Int. Cl.[7] ..... E02B 7/02; E02B 3/12

(52) U.S. Cl. ..... 405/116; 405/19; 405/111; 405/114

(58) Field of Search ..... 405/19, 111, 114, 405/115, 116, 107

(56) References Cited

U.S. PATENT DOCUMENTS

| | | | | | |
|---|---|---|---|---|---|
| 3,172,267 | A | | 3/1965 | Fisher | 405/107 |
| 3,186,896 | A | | 6/1965 | Clem | 428/182 |
| 3,886,751 | A | | 6/1975 | Labora | 405/107 |
| 4,362,433 | A | | 12/1982 | Wagner et al. | 405/107 |
| 4,391,925 | A | | 7/1983 | Mintz et al. | 523/130 |
| 4,401,475 | A | | 8/1983 | Eriksson et al. | 134/6 |
| 4,405,257 | A | | 9/1983 | Nielsen | 405/19 |
| 4,650,368 | A | | 3/1987 | Bayer | 405/111 |
| 4,921,373 | A | | 5/1990 | Coffey | 405/115 |
| 5,195,846 | A | | 3/1993 | Lemperiere | 405/108 |
| 5,241,783 | A | | 9/1993 | Krueger | 47/65.8 |
| 5,454,668 | A | | 10/1995 | Liao | 405/117 |
| 5,536,111 | A | | 7/1996 | Doernemann | 405/16 |
| 5,584,599 | A | | 12/1996 | Knittel | 405/15 |
| 5,609,438 | A | | 3/1997 | Liao | 405/117 |
| 5,617,920 | A | * | 4/1997 | Dovan et al. | 405/270 |
| 5,632,573 | A | | 5/1997 | Baker | 405/111 |
| 5,636,938 | A | | 6/1997 | Ragazzo | 405/15 |
| 5,915,879 | A | | 6/1999 | Burnett et al. | 405/116 |
| 5,934,027 | A | | 8/1999 | Khalili | 52/167.1 |
| 5,984,576 | A | | 11/1999 | Zetzsch | 405/110 |
| 6,012,872 | A | * | 1/2000 | Perry et al. | 405/111 |
| 6,022,172 | A | | 2/2000 | Siyaj | 405/110 |
| 6,296,420 | B1 | * | 10/2001 | Garbiso | 405/111 |

* cited by examiner

*Primary Examiner*—Thomas B. Will
*Assistant Examiner*—Tara L. Mayo
(74) *Attorney, Agent, or Firm*—Northern Michigan Patent Law, PLC

(57) ABSTRACT

A pouch (18), made of a water absorbent polymer that expands and becomes a gel in consistency upon absorbing water and that is biodegradable, is placed in each bag (10) of lesser volume. An opening (12) in each bag (10) is unsealed to drain the bags (10) of the biodegradable gel, as by squeezing the bag (10) to force the gel from the bag (10). The collapsed bags (10) can be re-stored for future use and the gel biodegraded as by disposition the conventional sewage system.

6 Claims, 2 Drawing Sheets

COLLAPSIBLE AND RE-USABLE FLOOD BARRIER

RELATED APPLICATIONS

This application is a continuation of Ser. No. 09/929,467, filed Aug. 14, 2001 now abandoned.

BACKGROUND OF THE INVENTION

1. Field of the Invention

A flood water barrier system utilizing a plurality of stacked bags to contain floodwaters.

2. Description of the Prior Art

It is well known to construct containment barriers of sand filled bags in flood conditions. The filling of the sandbags is labor intensive and the bags filled with sand are heavy to stack. Furthermore, the removal of the sand from the bags after the flood conditions have subsided is also labor and equipment intensive, plus the problem of getting rid of the sand.

To alleviate these disadvantages, it has been proposed to provide a porous bag having a quantity of water absorbent and expandable material occupying a small volume within the bag to substantially fill the bag when exposed to water coming through the porous walls of the bag. This is disclosed in U.S. Pat. No. 4,650,368 to Bayer. However, there remains the problem of disposing of the bags after the flood conditions have subsided.

SUMMARY OF THE INVENTION AND ADVANTAGES

The subject invention provides a flood water barrier bag system comprising a bag made of water impervious material with a sealable opening, and a pouch of a water absorbent polymer that expands and becomes a gel in consistency upon absorbing water. The resulting gel is biodegradable. The pouch contains less volume than the maximum volume of the bag for expanding into the gel in response to absorbing water to expand the volume of the bag and for flowing out of the bag when the bag is unsealed.

In accordance with the invention, a plurality of bags and pouches may be stored until flood conditions exist whereupon one of the pouches is placed in each bag and the bag filled with water to expand the bag as the polymer expands into a gel to expand the volume of each bag. The bags are sealed and stacked to form a water barrier. After the flood conditions subside, the bags are unstacked and unsealed to allow the gel to flow from each bag. The gel is biodegraded in an acceptable environment. The bags may be collapsed and stored for re-use.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE PREFERRED EMBODIMENT

Figure 1:
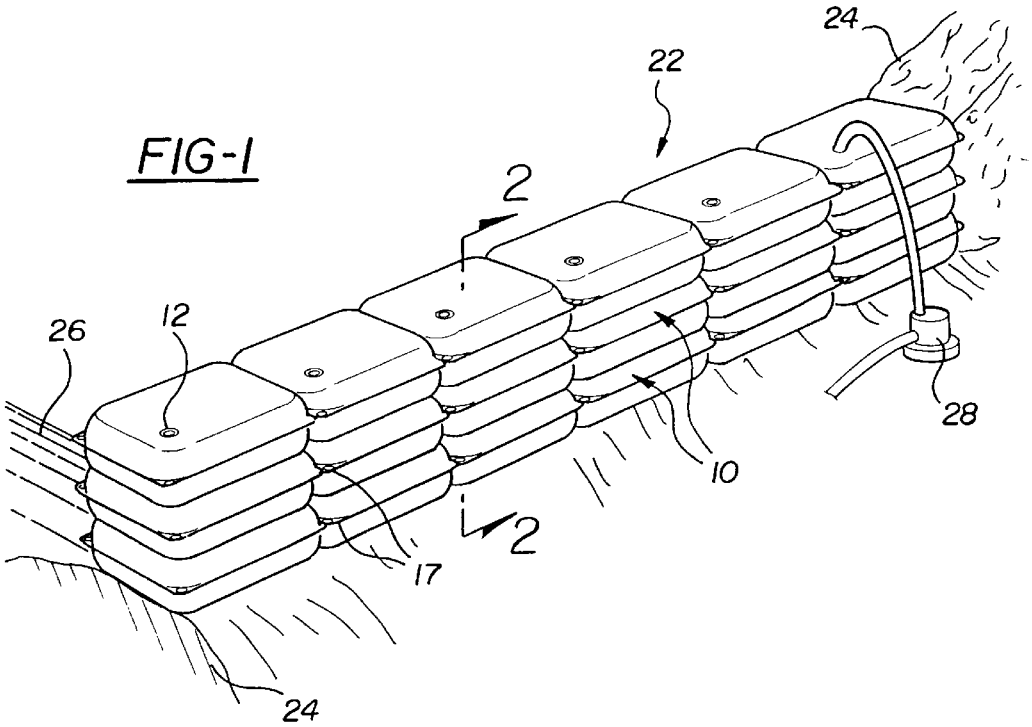
FIG. 1 is a perspective view of a flood barrier constructed in accordance with the subject invention.
Figure 2:
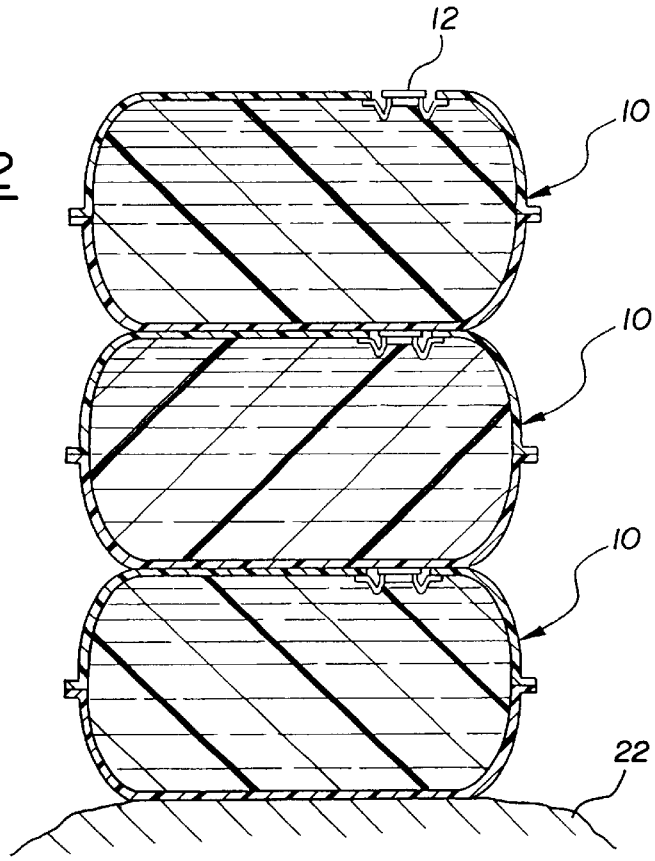
FIG. 2 is a cross sectional view taken along line 2—2 of FIG. 1.
Figure 3:
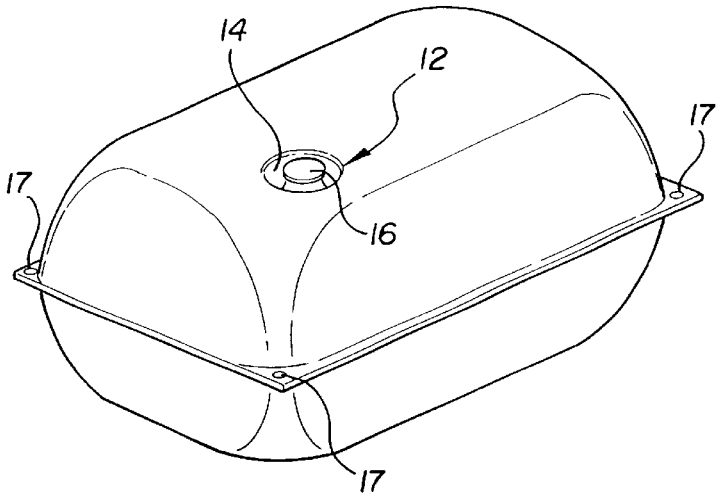
FIG. 3 is a perspective view of a single bag of the subject invention and in the expanded condition.
Figure 4:
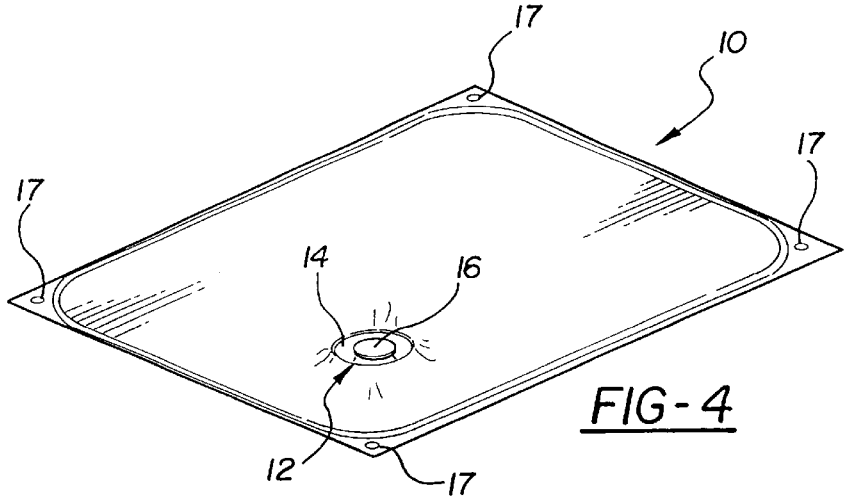
FIG. 4 is a perspective view of a single bag of the subject invention and in the collapsed condition.

Referring to the Figures, wherein like numerals indicate like or corresponding parts throughout the several views, a bag is generally indicated at 10 for use in the flood water barrier bag system of the subject invention.

The bag 10 is made of water impervious material, e.g., a flexible but heavy-duty plastic. Each bag 10 includes a sealable opening, generally indicated at 12. The opening 12 is defined by a plastic insert 14 for receiving a threaded cap 16. The bags 10 and the opening 12 therein may be like the bags that are filled with water and disposed around the periphery of a swimming pool to weight down a cover during the winter months. The bags 10 may also include grommets 17 for tying the bags together with a rope, or the like.

Figure 5:
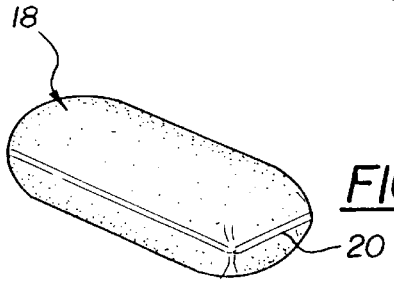
FIG. 5 is an enlarged perspective view of a pouch of the subject invention.
Figure 6:
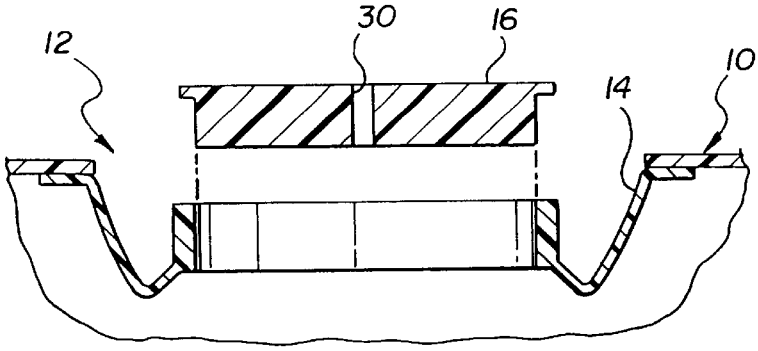
FIG. 6 is a fragmentary cross-sectional view of the filler/drain cap section of the bag.

A pouch generally indicated at 18 of a water absorbent polymer is also included and is sharing enlarged in FIG. 5. Actually, the pouch 18 is small enough to be inserted through the opening 12 and into the bag 10. The pouch 18 expands and becomes a gel in consistency upon absorbing water. In addition, the polymer of which the pouch is made is biodegradable. An example of such a polymer is sold by Emerging Technologies Incorporated located at 12-F Wendy Court, Greensboro, N.C. 27409 under the identification AP75 super Absorbent Polymer. The pouch 18 occupies less volume than the maximum volume of the bag 10 and expands into a gel in response to absorbing water to expand the volume of the bag 10. The pouch 18 includes a pervious container or woven sack 20 (e.g., tea bag material) surrounding the granular polymer and the container sack 20 is burstable in response to the expansion of the polymer. In other words, the container sack 20 allows the water to penetrate the interior thereof and expand the granular polymer therein so that the expanding polymer ruptures or bursts the container sack 20 to fill the remaining volume of the bag 10. In the end of use, the gel flows out of the bag 10 as removing the cap 12 unseals the bag 10. The collapsed container sack 20 could flow out of the bag 10 with the biodegradable gel.

The invention provides a method of forming a water barrier as generally shown at 22 in FIG. 1. The barrier 22 is shown as disposed between the edges of a break in a levee 24 for retaining floodwaters 26.

The method comprises the steps of storing a plurality of bags 10 each made of water impervious material and including a sealable opening 12. Also included is the step of storing a plurality of pouches 18 of a water absorbent polymer that expands and becomes a gel in consistency upon absorbing water and that is biodegradable. The pouch 18 has less volume than the maximum volume of each bag 10. In other words, the pouches 18 are smaller than the bags 10 and are separately stored and inserted in the bags 10 just prior to use.

The method continues by placing one of the pouches 18 in each bag 10 and filling each bag 10 to about one half full with water to expand the bag 10 as the polymer expands into a gel expanding thereby completely the volume of each bag 10. The pouch 18 placed in the container has the polymer surrounded by a pervious container sack 20 and the method, therefore, includes the step of bursting the container sack 20 as the polymer expands.

The bags 10 may be filled with water from a traditional source or from a pump 28 that pumps the flood water 26 into each bag 10.

After each bag is filled with water, the opening 12 in each bag 10 is sealed by threading the cap 16 closed to prevent egress of the gel from the bag 10. The cap 16 has a vent passage 30 to egress of air as the polymer expands.

Stacking the bags 10 as shown in FIG. 1 forms the barrier 22. After the flood conditions have subsided, the method continues by unstacking the bags 10 to dismantle the barrier 22. After or before the bags 10 are unstacked, the opening 12 in each bag 10 is unsealed by removing the caps 16 to drain the bags 10 of the flowable biodegradable gel. In other words, the method includes the step of flowing the gel from each bag 10, e.g., as by squeezing the bag 10 in the fashion of squeezing toothgel from a tube.

After the gel flows out of each bag 10, each bag 10 is collapsed and re-stored in an appropriate facility to await re-use in the next flood. Alternatively, a pump 28 could suck the gel out of the bags 10.

The method is particularly significant in the step of biodegrading the gel. This is very important in that the gel may be disposed of by disposition in an appropriate land fill or on agricultural land for re-use to store water for crop growth.

Obviously, many modifications and variations of the present invention are possible in light of the above teachings. The invention may be practiced otherwise than as specifically described within the scope of the appended claims, In addition, the reference numerals in the claims are merely for convenience and are not to be read in any way as limiting.

What is claimed is:

1. A method of forming a water baffler comprising the steps of:

storing a plurality of bags (10) each made of water impervious material and including a sealable opening (12), storing a plurality of pouches (18) of a water absorbent polymer that expands and becomes a gel in consistency upon absorbing water and that is biodegradable with each pouch (18) having less volume than the maximum volume of each bag (10), placing the polymer of at least one of the pouches (18) in each bag (10), filling each bag (10) with a predetermined amount of water to expand each bag (10) as the polymer expands into a gel expanding the volume of each bag (10), sealing the opening (12) in each bag (10) to prevent egress of the gel from the bag (10), stacking the bags (10) to form a water baffler, unstacking the bags (10), unsealing the opening (12) in each bag (10), flowing the gel from each bag (10), collapsing each bag (10), biodegrading the gel, re-storing the collapsed bags (10) for re-use.

2. A method as set forth in claim 1 including placing a pouch having the polymer surrounded by a pervious container (20) and bursting the container (20) as the polymer expands.

3. A method of providing a water barrier system comprising the steps of:

providing a plurality of bags (10) each made of water impervious material and including a sealable opening (12); and providing a plurality of pouches (18) of a water absorbent polymer that expands and becomes a flowable gel in consistency upon absorbing water and that is biodegradable with the polymer of each pouch (18) having less volume than the maximum volume of each bag (10);

further including the step of placing the polymer of one of the pouches (18) in each bag (10).

4. A method as set forth in claim 3 including the steps of:

filling each bag (10) with water to expand the bag (10) as the polymer expands into a gel expanding the volume of each bag (10), sealing the opening (12) in each bag (10) to prevent egress of the gel from the bag (10), and stacking the bags (10) to form a water barrier.

5. A method as set forth in claim 4 including the steps of;

unstacking the bags (10), unsealing the opening (12) in each bag (10), flowing the gel from each bag (10), biodegrading the gel.

6. A method as set forth in claim 3, wherein each pouch (18) includes a pervious container (20) surrounding the polymer, further including the steps of expanding the polymer in the container and bursting the pervious container in the bag as the polymer expands.

* * * * *

UNITED STATES PATENT AND TRADEMARK OFFICE

CERTIFICATE OF CORRECTION

PATENT NO. : 6,715,960 B2
DATED : April 6, 2004
INVENTOR(S) : Donald H. Metz

It is certified that error appears in the above-identified patent and that said Letters Patent is hereby corrected as shown below:

Column 3,
Line 35, change “baffler” to -- barrier --.

Column 4,
Line 3, change “baffler” to -- barrier --.

Signed and Sealed this

First Day of June, 2004

JON W. DUDAS
*Acting Director of the United States Patent and Trademark Office*